United States Patent [19]

Kidd

[11] Patent Number: 5,011,011

[45] Date of Patent: Apr. 30, 1991

[54] TRAY FOR TRANSPORTING VEHICLE TURBOCHARGERS

[75] Inventor: Garry B. Kidd, Novi, Mich.

[73] Assignee: Chrysler Corporation, Highland Park, Mich.

[21] Appl. No.: 559,115

[22] Filed: Jul. 26, 1990

[51] Int. Cl.[5] ..... B65D 85/68

[52] U.S. Cl. ..... 206/319; 206/386; 206/564; 206/587

[58] Field of Search ..... 206/318–320, 206/335, 386, 523, 564, 587, 593; 217/27, 35

[56] References Cited

U.S. PATENT DOCUMENTS

| | | | |
|---|---|---|---|
| 3,580,467 | 5/1971 | Pieszak et al. | 206/319 |
| 3,777,885 | 12/1973 | Barteck | 206/319 |
| 4,480,748 | 11/1984 | Wind | 206/593 |
| 4,892,196 | 1/1990 | Okajima | 206/593 |

*Primary Examiner*—Jimmy G. Foster

*Attorney, Agent, or Firm*—Edward A. Craig

[57] ABSTRACT

A tray is provided for transporting vehicle turbochargers which have a non-symmetrical shape which must be adequately supported to prevent movement thereof during shipment. The tray includes a plurality of cradles each of which receives a turbocharger and supports the turbocharger in such a fashion as to prevent longitudinal or transverse movement. Vertical movement is prevented by use of lids on the trays.

6 Claims, 4 Drawing Sheets

TRAY FOR TRANSPORTING VEHICLE TURBOCHARGERS

BACKGROUND OF THE INVENTION

1. Field of the Invention

This invention relates to a tray for transporting vehicle turbochargers. The tray is reusable. The tray includes various support structure for receiving and supporting different portions of a turbocharger.

2. Prior Art

In modern automotive manufacturing, it is common practice to assemble complete vehicles at a single location from various parts and components which are shipped to the assembly location from other locations. The parts and components are normally fabricated in facilities remote from the assembly location, packaged and then shipped to the assembly locations. The packaging frequently has involved the use of cardboard. This has caused a problem at the point of use. The cardboard packages create a disposal problem. The disposal of such cardboard materials has engendered relatively high costs.

It is desired to use returnable containers, particularly containers constructed of plastic materials. Such containers are relatively light weight while at the same time being sturdy and durable in use.

However, a problem has been encountered in connection with the shipment of vehicle turbochargers. Turbochargers are relatively delicate components and are easily damaged if subjected to impact or abrasion forces. Further, the mechanism of turbochargers is desirably maintained without contamination. Cardboard packaging techniques have continued to be used in connection with turbochargers because of the difficulty in providing a contamination-free container environment which also prevents impacting of the turbochargers during shipment. This is particularly true when shipment is made by ocean freighters. Ocean freighters are subject, of course, to considerable turbulence during inclement weather. Therefore, packaging of turbochargers has had to be done is such a way as to result in no damage to the turbochargers even if the ocean freighter tilts or lists as a consequence of storms and heavy seas.

In accordance with the present invention, a reusable tray for transporting vehicle turbochargers is provided. The tray is fabricated of a plastic material which has relatively high strength but also has a relatively soft and smooth surface and is flexible. Suitable plastic is, for example, a high density polyethylene copolymer. This resin has superior stress crack resistance combined with high impact strength and rigidity. It is suitable for use in molding of large containers. The construction of the tray is adapted to prevent scratching, gouging or like damage to turbochargers during storage and transport. The tray of the present invention provides separation of the turbochargers and also provides a smooth surface for contact with the turbochargers which will not abrade or otherwise damage the surfaces. The tray is reusable and thus does not involve a disposal problem at assembly points. The construction of the trays makes maximum utilization of space. The reusable nature of the trays results in an ultimate lower cost. Further, the trays are stackable to form a desired shipping size. A pallet and lid are provided for stacks of trays and permit banding of the trays together in a stack which is solid and which is sealed to prevent contamination of the contents of the trays.

SUMMARY OF THE INVENTION

A tray for transporting vehicle turbochargers is provided. The turbochargers comprise a generally cylindrical primary body portion having a longitudinal axis. A generally cylindrical secondary body portion extends outwardly from one end of the primary body portion and has a longitudinal axis substantially perpendicular to the longitudinal axis of the primary body portion. A generally cylindrical first arm is provided adjacent the other end of the primary body portion and extends radially outwardly therefrom. The first arm has a longitudinal axis substantially perpendicular to the longitudinal axis of the primary body portion and oblique to the longitudinal axis of the secondary body portion. A generally cylindrical second arm is provided on said other end of the primary body and extends axillary outwardly therefrom. A first bracket extends radially outwardly from one side of the outer periphery of the primary body portion intermediate the outer ends thereof. A second bracket extends radially outwardly from the opposite side of the outer periphery of the primary body portion intermediate the outer ends thereof.

A projection extends radially outwardly from the outer periphery of the primary body portion intermediate the first and second brackets. The primary body portion has a recess extending radially inwardly from the outer periphery thereof between the first bracket and projection. A flange is provided at the outer end of the secondary body portion extending radially outwardly.

The tray comprises a generally rectangular tray body having a bottom wall with side and end walls extending upwardly therefrom. A plurality of cradles, each for receiving a turbocharger, project upwardly from the upper surface of the bottom wall. Each cradle includes a first platform to support the turbocharger projection. An upwardly extending projection on the first platform is provided for extending into the turbocharger recess. The first platform has a first recess adjacent the lastmentioned projection to receive the first turbocharger bracket.

A second platform extends upwardly at an angle from the first platform. The second platform has a second recess to receive the second turbocharger bracket. The lastmentioned projection and first and second recesses restrain longitudinal and transverse movement of turbocharger received in the cradle.

The cradle further includes a third platform adjacent one side of the second platform to support the outer end of the turbocharger secondary body portion with a portion of the flange thereof extending downwardly from the end of the third platform. A fourth platform having a V-shape is provided on the other side of the second platform adjacent to both the first and second platforms to support the first turbocharger arm. A fifth platform is provided adjacent the fourth platform to support the second turbocharger arm. An upstanding wall is provided adjacent each side of the first platform to restrain turbocharger movement.

DETAILED DESCRIPTION OF A PREFERRED EMBODIMENT

Figure 1:
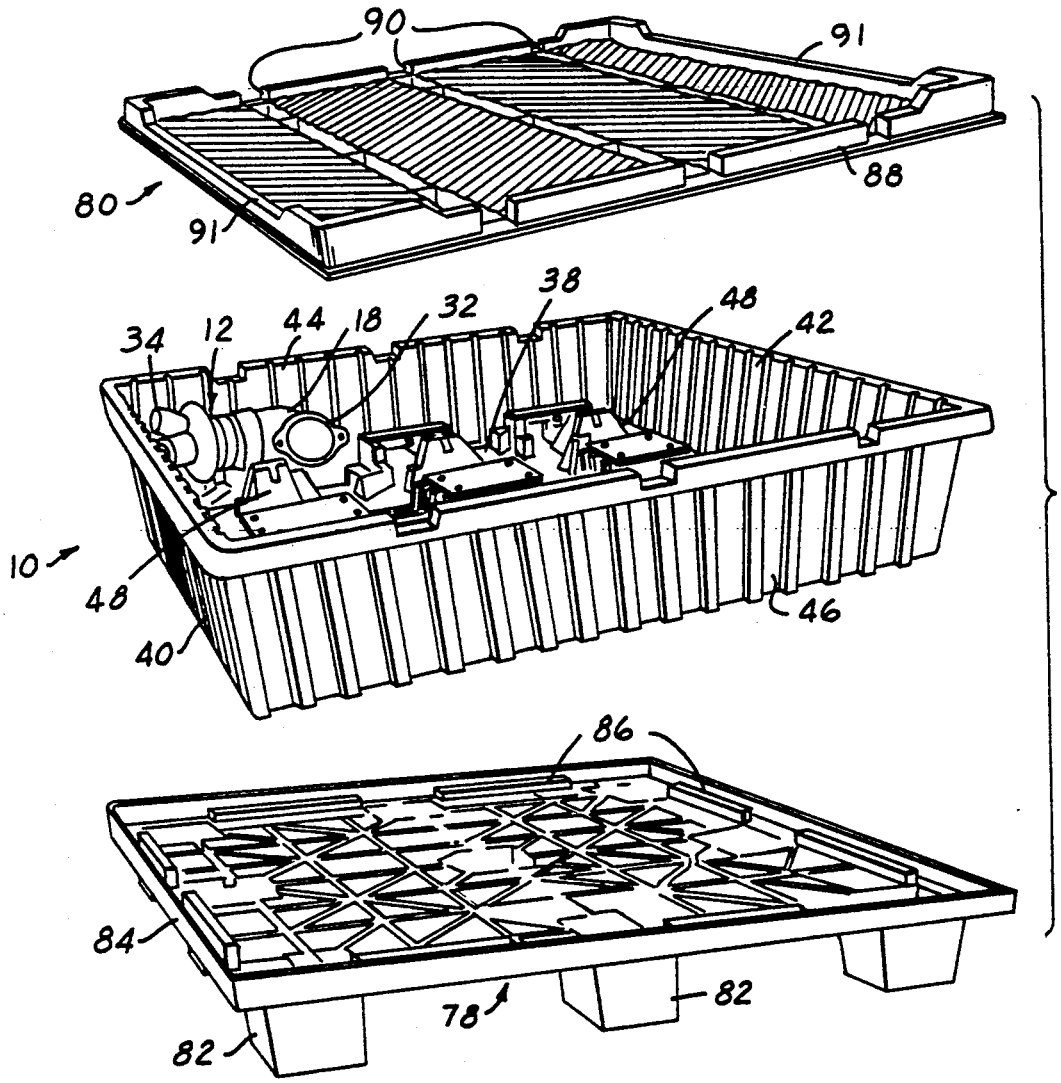
FIG. 1 is an exploded view in perspective of one embodiment of the present invention illustrating the tray of the invention, a lid for the tray and a pallet for a stack of trays.

Referring to the drawings, it will noted that the tray 10 is designed to receive and support a plurality of vehicle turbochargers 12. The turbochargers 12 have a non-symmetrical shape that presents difficulties in providing a suitable cradle for receiving the turbochargers. As previously discussed, the turbochargers must be mounted in such a way as to be firmly in place while at the same time not subject to abrasion or impacting of the turbocharger surfaces.

Figure 7:
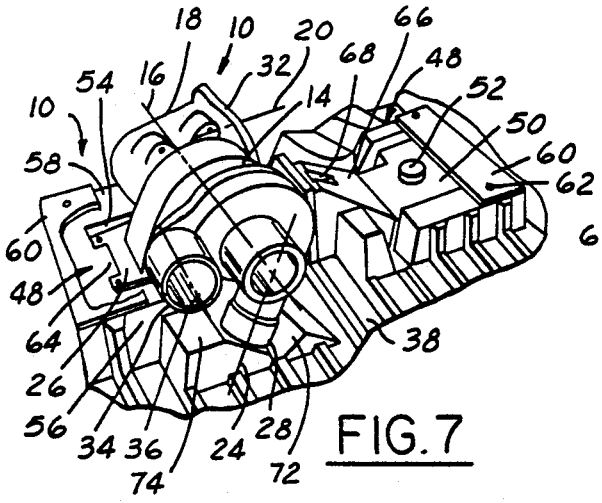
FIG. 7 is a view in perspective similar to FIG. 6 taken from the opposite side thereof.
Figure 6:
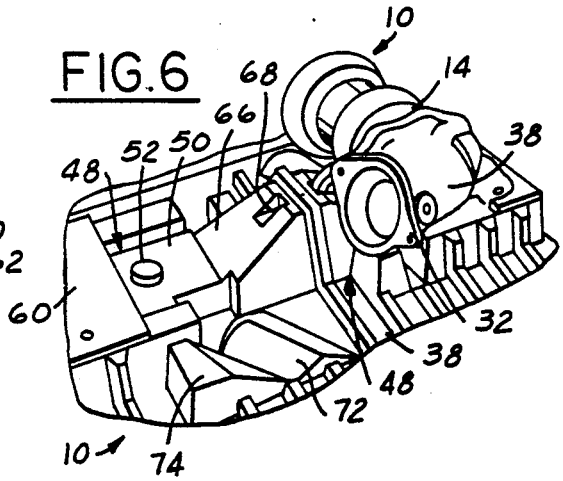
FIG. 6 is a view in perspective similar to FIG. illustrating a vehicle turbocharger received on a cradle provided within the tray.

The basic shape of the turbochargers will first be described. The turbochargers 12 are illustrated in most of the figures. Each turbocharger 12 comprises a generally cylindrical primary body portion 14 having a longitudinal axis 16 as will be noted in FIG. 7. A generally cylindrical secondary body portion 18 extends outwardly from one end of the primary body portion 14. The secondary body portion 18 has a longitudinal axis 20 which is substantially perpendicular to the longitudinal axis 16 of the primary body portion 14. A generally cylindrical first arm 22 is provided adjacent the other end of the primary body portion 14 and extends radially outwardly therefrom. The first arm 22 has a longitudinal axis 24 which is substantially perpendicular to the longitudinal axis 16 of the primary body portion 14 and which is oblique to the longitudinal axis 20 of the secondary body portion 18.

Figure 5:
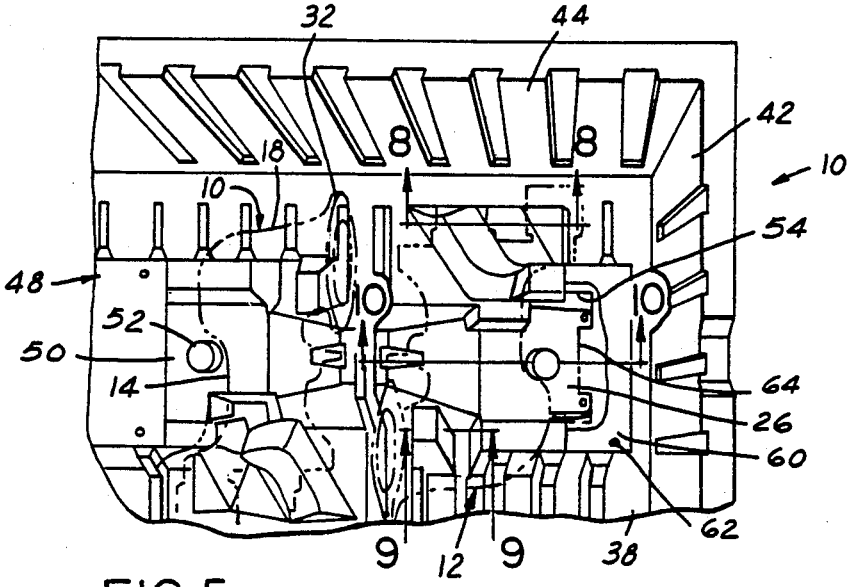
FIG. 5 is a top plan view of one corner of the tray.

A first bracket 26 extends radially outwardly from one side of the outer periphery of the primary body portion 14 intermediate the outer ends of the primary body portion. As will be noted in FIGS. 5 and 7, the first bracket 26 is forked. A second bracket 28 extends radially outwardly from the opposite side of the outer periphery of the primary body portion 14 intermediate the outer ends of the primary body portion. A projection 30 extends radially outwardly from the outer periphery of the primary body portion 14 intermediate the first and second brackets 26, 28 as will be noted in FIG. 10. The primary body portion 14 has a recess 29 extending radially inwardly from the outer periphery thereof between the first bracket 26 and projection 30. A flange 32 is provided at the outer end of the secondary body portion 18. The flange extends radially outwardly. A generally cylindrical second arm 34 is provided on the end of the primary body portion 14 adjacent to the first arm 22. The second arm 34 has a longitudinal axis 36 and extends axially outwardly from the end of the primary body portion 14.

Figure 3:
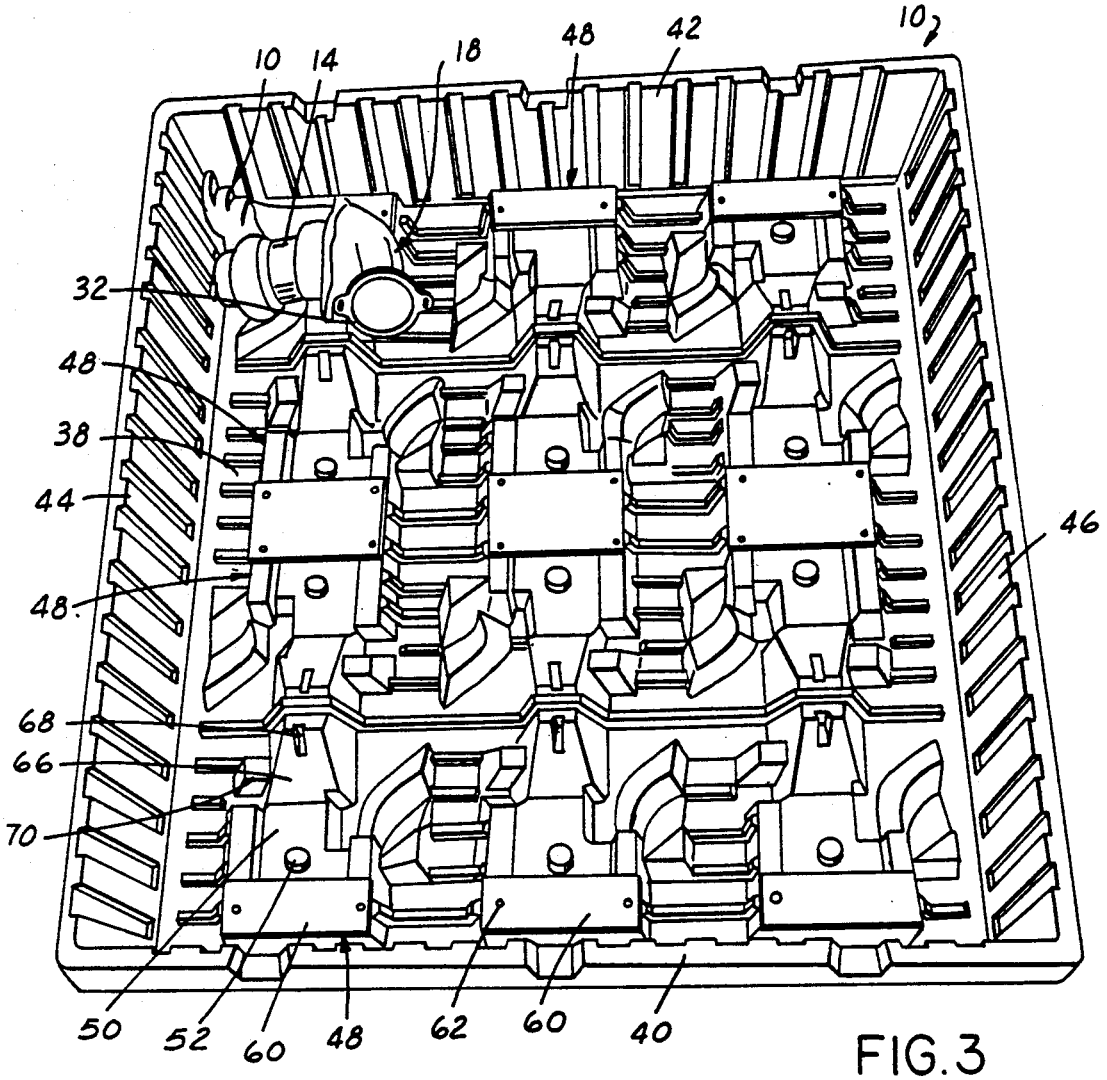
FIG. 3 is a view in perspective looking into a tray.
Figure 4:
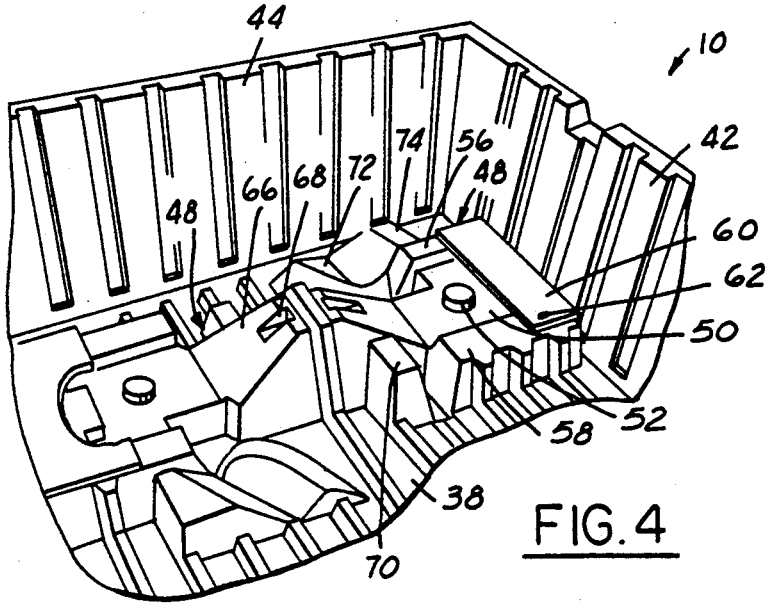
FIG. 4 is an enlarged view in perspective of one corner of a tray illustrating the cradle structure which receives and positions vehicle turbochargers.

The tray 10 comprises a generally rectangular tray body having a bottom wall 38 with end walls 40, 42 and side walls 44, 46 extending upwardly therefrom. A plurality of cradles 48, each for receiving a turbocharger 12, project upwardly from the upper surface of the bottom wall 38. As will be noted in FIG. 3, pairs of cradles 48 are provided end-to-end, there being representively 12 cradles 48 provided on the bottom wall 38.

Figure 10:
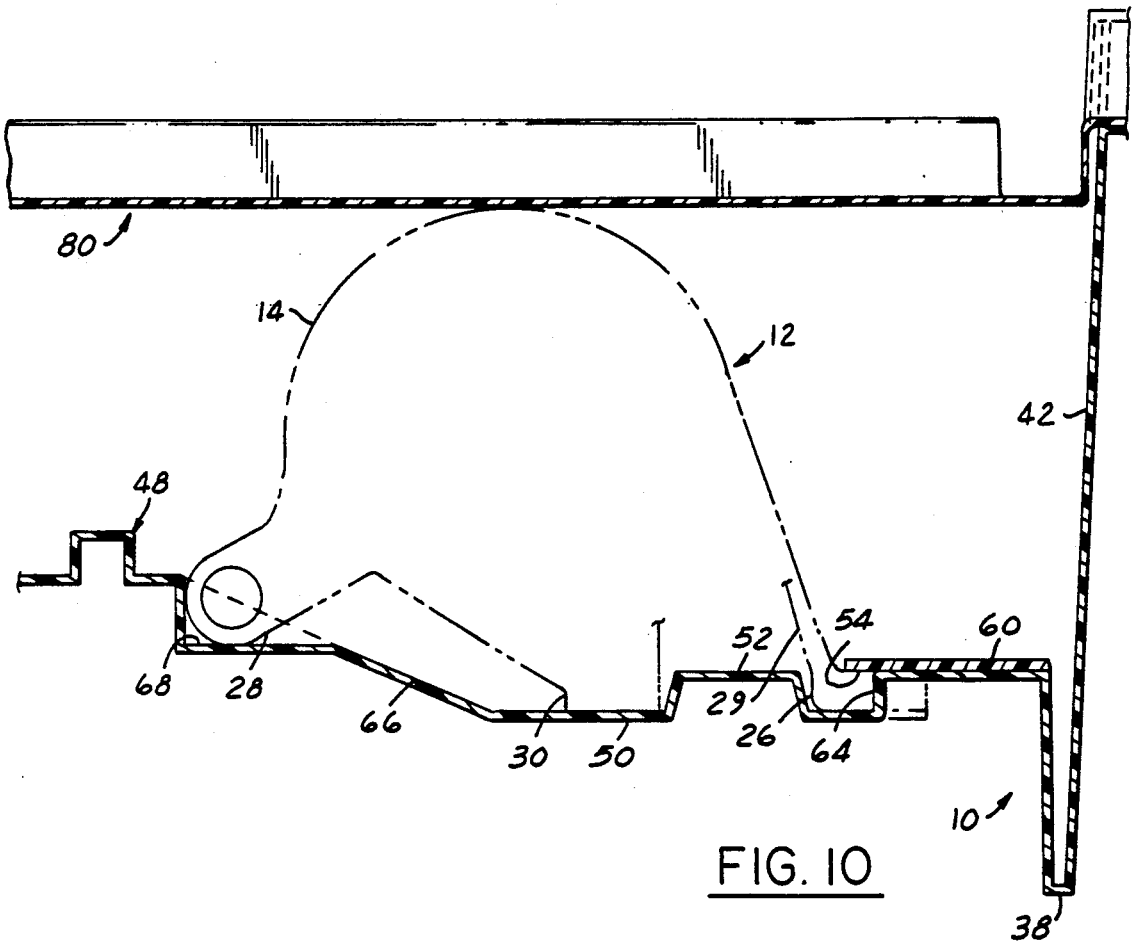
FIG. 10 is a sectional view taken substantially along the line 10—10 of FIG. 5 looking in the direction of the arrows with a lid positioned on top of the tray.

Each cradle 48 includes a first platform 50 to support a turbocharger projection 30. An upwardly extending cylindrical projection 52 is provided on the first platform 50 for extending into the turbocharger recess 29 as shown in FIG. 10. The first platform 50 has a first recess 54 adjacent the projection 52 to receive the first turbocharger bracket 26. The recess 54 is defined by upstanding walls 56, 58 across which extends a slat 60 which is secured to the walls 56, 58 by means of screws 62. As will be noted in FIG. 5, a center projection 64 is provided to accommodate the forked nature of the first bracket 26.

A second platform 66 extends upwardly at an angle from the first platform 50. The second platform 66 has a second recess 68 to receive the second turbocharger bracket 28. The projection 64, first recess 54, and second recess 68 restrain longitudinal and transverse movement of the turbocharger 12 received in the cradle 48. This arrangement essentially fixes the turbocharger 12 in place and prevents unwanted movement thereof during shipment.

Figure 8:
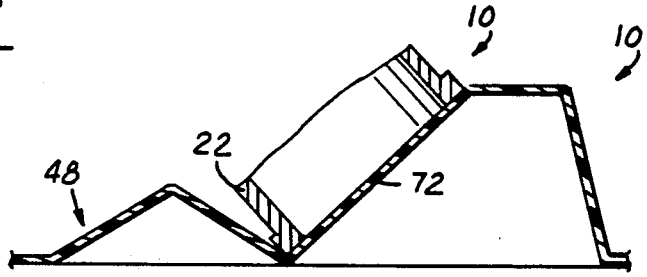
FIG. 8 is a sectional view taken substantially along the line 8—8 of FIG. 5 looking in the direction of the arrows.
Figure 9:
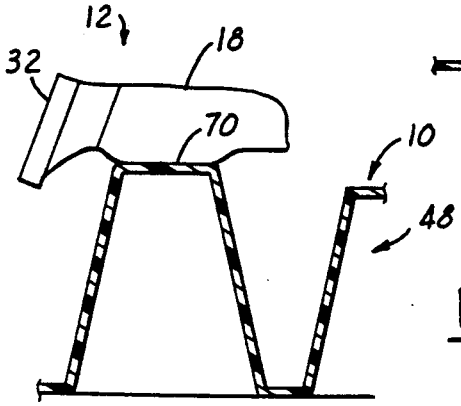
FIG. 9 is a sectional view taken substantially along the line 9—9 of FIG. 5 looking in the direction of the arrows.

A third platform 70 is provided adjacent the second platform 66 to support the outer end of the turbo charger secondary body portion 18 with a portion of the flange 32 thereof extending downwardly from the end of the third platform 70 as will be noted in FIG. 9. A fourth platform 72 having a V-shape is provided on the other side of the platform 66 adjacent to the first platform 50 and second platform 66. The fourth platform 72 supports the first turbocharger arm 22 as will be noted in FIG. 8. A fifth platform 74 is provided adjacent the fourth platform 72 to support the second turbocharger arm 34 as will be noted in FIG. 7.

Figure 2:
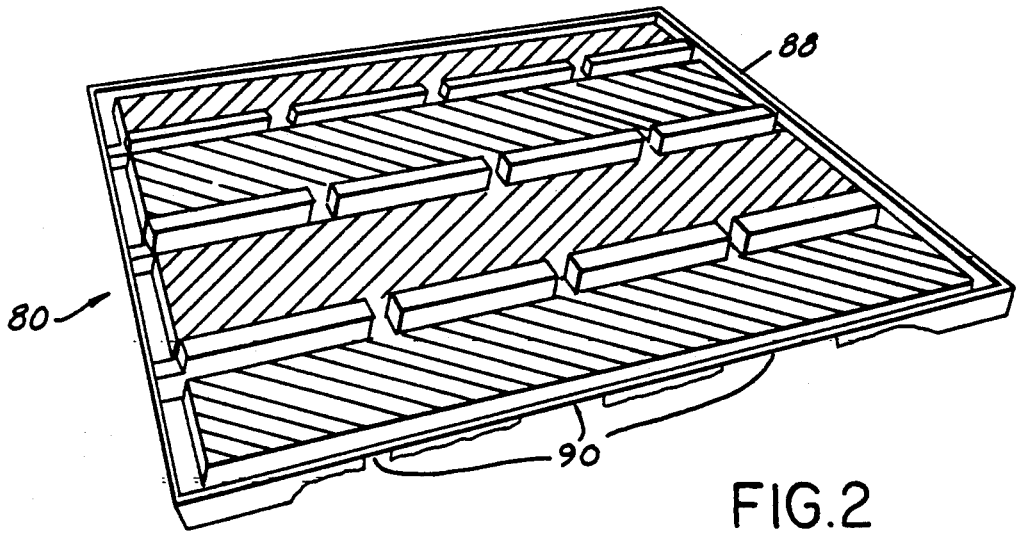
FIG. 2 is a view in perspective of the underside of a tray lid.
Figure 11:
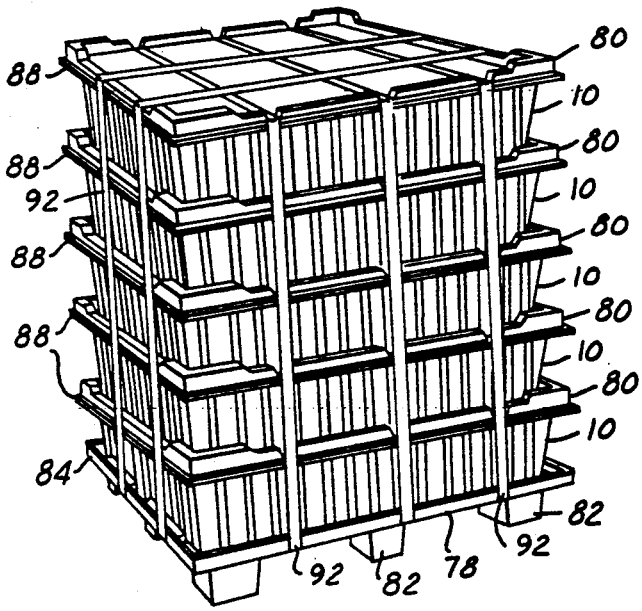
FIG. 11 is a view in perspective illustrating a stack of trays with lids in place mounted on a pallet and banded together to form a shipping unit.

After a tray 10 has been loaded with turbochargers 12, it is formed into a closed unit and stacked for shipping. Reference is made to the structure shown in FIGS. 1, 2 and 11. As will be noted in FIG. 1, a pallet 78 is provided to support a tray 10. A lid 80 is provided for capping each tray 10. Each pallet 78 has a plurality of legs 82 to raise the tray from the floor level and permit lifting of a stack of trays by a fork lift truck. Each pallet 78 has a side wall structure 84 for receiving and retaining the bottom of a tray 12. A plurality of projections 86 are provided for interfitting with a tray to prevent movement thereof. Each lid 80 has a side wall structure 88 to fit over the top of a tray. A plurality of side notches 90 and large end notches 91 are provided on the upper surface of the lid 80 to receive banding 92 on both the ends and the sides of a stack of trays to secure a stack of trays as an integral unit. Preferably, five trays are provided in each stack to result in a very desirable shipping unit which makes maximum use of the space in the kind of cargo trailer used for shipping by ocean freighter. As will be noted in FIG. 10, the lid 80 presses against the upper surface of the turbochargers thus firmly securing the turbochargers in the vertical direction. When trays are stacked, the turbocharger superadjacent masses press against turbocharger subjacent masses to form a solid columnar effect.

I claim:

1. A tray for transporting vehicle turbochargers which comprise a generally cylindrical primary body portion having a longitudinal axis, a generally cylindrical secondary body portion extending outwardly from one end of the primary body portion having a longitudinal axis substantially perpendicular to the longitudinal axis of the primary body portion, a generally cylindrical first arm adjacent the other end of the primary body portion extending radially outwardly therefrom and having a longitudinally axis substantially perpendicular to the longitudinal axis of the primary body portion and oblique to the longitudinal axis of the secondary body portion, a generally cylindrical second arm having a longitudinal axis portion which extends axially outwardly from the primary body portions, a first bracket extending radially outwardly from one side of the outer periphery of the primary body portion intermediate the outer ends thereof, a second bracket extending radially outwardly from the opposite side of the outer periphery of the primary body portion intermediate the outer ends thereof, a projection extending radially outwardly from the outer periphery of the primary body portion intermediate the first and second brackets, the primary body portion having a recess extending radially inwardly from the outer periphery thereof between the first bracket and projection, and a flange at the outer end of the secondary body portion extending radially outwardly; the tray comprising a generally rectangular tray body having a bottom wall, side and end walls extending upwardly from the bottom wall, a plurality of cradles each for receiving a turbocharger projecting upwardly from the upper surface of the bottom wall, each cradle including a first platform to support the turbocharger projection, an upwardly extending projection in the first platform for extending into the turbocharger recess, the first platform having a first recess adjacent the lastmentioned projection to receive the first turbocharger bracket, a second platform extending upwardly at an angle from the first platform, the second platform having a second recess to receive the second turbocharger bracket, the lastmentioned projection and first and second recesses restraining longitudinal and transverse movement of a turbocharger received in the cradle.

2. A tray as defined in claim 1, wherein a third platform is provided adjacent one side of the second platform to support the outer end of the turbocharger secondary body portion with a portion of the flange thereof extending downwardly from the end of the third platform.

3. A tray as defined in claim 2, wherein a fourth platform having a V-shape is provided on the other side of the second platform adjacent to both the first and second platforms to support the first turbocharger arm.

4. A tray as defined in claim 3, wherein a fifth platform is provided adjacent the fourth platform to support the second turbocharger arm.

5. A tray as defined in claim 1, wherein an upstanding wall is provided adjacent each side of the first platform to restrain turbocharger movement.

6. A tray as defined in claim 1, wherein a lid is provided for reception on the tray, the lid adapted to press against turbochargers loaded in the tray to prevent vertical movement thereof.

* * * * *